United States Patent [19]

Lyons

[11] 4,209,128

[45] Jun. 24, 1980

[54] METHODS AND APPARATUS FOR CLASSIFYING FINE PARTICLE SOLIDS

[75] Inventor: Sanford C. Lyons, Bennington, Vt.

[73] Assignee: Yara Engineering Corporation, Springfield, N.J.

[21] Appl. No.: 27,844

[22] Filed: Apr. 6, 1979

[51] Int. Cl.[2] ..... B04B 1/00

[52] U.S. Cl. ..... 233/7; 233/28

[58] Field of Search ..... 233/7, 8, 9, 10, 27, 233/28

[56] References Cited

U.S. PATENT DOCUMENTS

| | | | |
|---|---|---|---|
| 2,097,420 | 10/1937 | Lyons | 233/18 |
| 3,200,068 | 8/1965 | Jonakin | 233/7 |
| 3,447,742 | 6/1969 | Eriksson | 233/7 |
| 3,727,831 | 4/1973 | Lyons | 233/7 |

*Primary Examiner*—Robert W. Jenkins

*Attorney, Agent, or Firm*—Buell, Blenko & Ziesenheim

[57] ABSTRACT

A method and apparatus are provided for classifying fine particle materials from a fluid suspension in the form of a rotatable cylindrical bowl, a rotatable shaft on which said bowl is rotated, means for independently rotating each of said bowl and shaft at appropriate differential speeds, a circular baffle on said shaft within said bowl between the ends of said bowl, defining one, of three, consecutive pools, a helical conveyor on said shaft on one side of said baffle in said one pool, said conveyor extending radially to a point adjacent the periphery of the bowl, a second pool beginning on the opposite side of said baffle and extending toward the effluent end of the bowl, a helical series of discontinuous radial spokes extending from said shaft in said second pool, and extending to points adjacent the periphery of the bowl, said second pool ending at a point where it joins a third pool of equal cross sectional dimension and extending toward the effluent end of the bowl, a ribbon-conveyor mounted on said shaft in said third pool whose outer periphery closely approaches the inner periphery of the bowl, an input port delivering slip to be centrifuged to the helical conveyor at one end of the bowl, a particle reject port at the same end of the bowl as the input port and a slip discharge port at the opposite end of said bowl spaced from its periphery.

10 Claims, 4 Drawing Figures

METHODS AND APPARATUS FOR CLASSIFYING FINE PARTICLE SOLIDS

This invention relates to methods and apparatus for classifying fine particle solids and particularly to a method and apparatus for centrifugal treatment of fine particle solids such as clay.

The commercial processing of fine particle solids is not new but goes back many years. In the field of clay processing it began about 1930 and got its greatest impetus from the discoveries outlined in U.S. Pat. No. 2,097,420 which, for the first time, postulated the significant difference in physical characteristics of clay, above and below the 2 micron equivalent spherical diameter (e.s.d.) level. A comprehensive yet condensed presentation of many of the basic principles which are involved in the centrifugal separation of clay particles at a preselected size, e.g. 2 m e.s.d. is set out in my U.S. Pat. No. 3,727,831 which relates to processing of clays by means of a so-called "scroll-type" centrifuge.

In hindsight it is ironic that aqueous solutions of clay appear to have been the original product chosen for centrifugal treatment in pioneer efforts to centrifugally classify or recover small solid particles from fluid suspensions and that fortunately so many succeed because out of pure luck the clays which were used were of a favorable type for the primitive centrifuges then available. We now know that the design of functional features of a scroll-type centrifuge by the use of rational calculations is not yet practical because of the many unknown and uncontrollable feed stock variables. Among these variables are the complex and varied rheological properties of clay, the particle shape, the aspect ratios, the ranges of size distribution, none of which are yet subject to precise quantitative evaluation. Thus, the interplay between the hydraulic shearing effects of the centrifugal conveyor flights, etc., versus the confronting effects of the bowl-"beach" face, etc., and the rheological responses of the different sediment-strata streams in the bowl can be determined only by experimental trial runs. Such trial runs are both time consuming and expensive.

The basic functional features of centrifugal treatment of fine particle solids in fluid suspension, whether it be clay in aqueous suspension or other fine particle solid in a suspension, is the necessity for maintenance of concurrent ejection of both the sedimented solids and the decanted solids at near uniform rates. This would, on its face, appear to be a simple and obvious principle and in many solid suspension systems it is, however, in the case of solids like clay the diverse and often dramatic differences in rheological and sedimentary behavior caused largely by differences in particle shape, as mentioned above make this a very difficult problem.

Some of the problems of centrifugally separating clay fractions are discussed in my earlier U.S. Pat. No. 3,727,831. As there mentioned, in the early years of centrifugal processing of clays, the tonnages produced were far smaller than is the situation today, so that when a crude clay was found that would not behave well in the centrifuge it was simply by-passed in favor of a good crude supply. The clay industry, along with many others, has come to realize that natural resources are not an unlimited resource and, unfortunately, the industry cannot simply by-pass large deposits of clay in favor of those more amenable to processing.

I have discovered that there are several anomolous changes which occur in centrifugal processing of certain clays. One of the more prevalent ones which I encountered was a "heavy type", intermediate size particle feed-slip which incurred much heavier gear leads at small cake tonnage and low feed roles, than did much larger feed rates and cake loads of coarser fractions of the same clay. Careful studies of these intermediate size "heavy liquid" type sediments showed them to develop a strong dilatant "silly-putty" type dilatant drag effect on the ribbon conveyor flights at the foot of the beach in centrifuges of the type described in my U.S. Pat. No. 3,727,831. The result is an effective adhesion to the conveyor flights which counteracts their friction effects on the bowl wall. Since these small particles sediment slowly, they form only a thin and narrow band of dilantancy adjacent to and adhering to the conveyor blades. Because of the comparatively small volume of this sediment, its coverage and/or frictional adherence to the bowl wall is low and much of the cake tends simply to rotate with the ribbon flights, instead of being wedged by them up the beach.

This additional stirring of the cake tends to prevent its consolidation and/or propellability, so that it develops a deeper viscous pool of sediment which then increases the amount of mechanical stirring required (gear load).

I have discovered that the continuous centrifuge disclosed in my earlier U.S. Pat. No. 3,727,831 can be modified to reduce these problems and particularly to reduce the gear load without detrimentally altering the rate or efficiency of the centrifuge but on the contrary actually increasing the rate of production. This is accomplished by eliminating the ribbon conveyors and providing only helically spaced radial projections or spokes, which may have fixed on their ends segments of metal or spades. I have found that by this change clay which is sedimented ahead of the radial spokes is propelled toward the base of the beach more readily than with a ribbon conveyor. This is probably the result of either "angle of repose" flow, supplemented by pressure from the sediment being deposited ahead of it or by narrow-band, stratified stirring and/or propulsion of the sediment across the gap by the spokes immersed therein. Whatever the mechanism, it works, contrary to what one skilled in this art would expect. Surprisingly a centrifuge modified according to the present invention functions better than anything heretofore available. It produces more tons per hour of a wide range of grades of clay and does this with a consistently lower torque on the conveyor drive which means a lower power per ton cost. This is very important because even before the present general concern over "energy" it had been recognized that power was the largest single direct operating cost for most centrifugal treatments. Moreover, excessive power loads, which represent something less than optimum operating efficiency impose excessive load stress on gear units and other parts of the centrifuge resulting in increased original cost in excess design and in maintenance costs due to wear.

I provide a centrifuge for classifying fluid suspensions having a range of particles from fine through intermediate to coarse which comprises a rotatable cylindrical bowl, a rotatable shaft on which said bowl is rotated, means for independently rotating each of said bowl and said shaft at appropriate different speeds, a circular baffle on said shaft within said bowl intermediate its ends defining one of three separate pools, a helical conveyor on said shaft on one side of said baffle, said conveyor extending radially to a point adjacent the periphery of the bowl, a plurality of spaced apart radial arms on said shaft extending radially outwardly to a point adjacent the bowl periphery on the side of the baffle opposite the conveyor, an input port delivering slip to be centrifuged to the helical conveyor at one end of the bowl, a particle reject port at the same end of the bowl as the input port and a slip discharge port at the opposite end of said bowl spaced from its periphery. Preferably, each of the spaced radial arms has a spade member on its outermost end adjacent the periphery of the bowl, which spades preferably have a helical cant to each of them. At the end of the shaft opposite the conveyor a plurality of axial, diagonal vanes such as Schwartz Cosap Units may be placed between the radial arms forming a third pool to aid in channeling the particles outwardly toward the bowl, coupled with a helical ribbon conveyor on the arm ends.

In the foregoing general description I have set out certain preferred practices and embodiments of my invention together with certain objects, purposes and advantages. Other objects, purposes and advantages will be apparent from a consideration of the following description and accompanying drawings in which.

Figure 1:
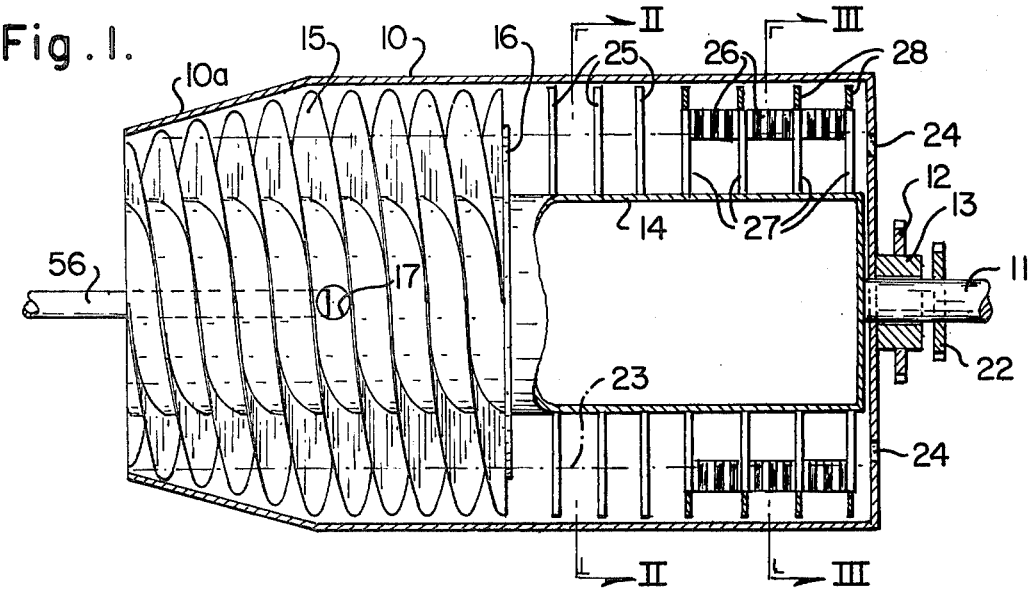
FIG. 1 is a longitudinal section of a centrifuge according to this invention.

Referring to the drawings I have illustrated a centrifuge bowl housing 10 of cylindrical form having a truncated conical end 10*a* mounted on a generally horizontal shaft 11 and driven for rotation through a gear 12 fixed to the journal 13. Within housing 10 and mounted on a shaft 11 is a conveyor hub 14 which carries a helical centrifugal conveyor 15 at one end and an intermediate baffle 16. The slip to be centrifuged is delivered through a pipe 56 into the axis of the conveyor hub and discharged through ports 17 in the hub into the area within the helical conveyor. The slip or slurry delivered by pipe 56 is preferably fed from a constant head tank (not shown) through an efflux control valve (not shown) into pipe 56.

The slip entering ports 17 is forced to follow a conical helical flow path formed by the helical conveyor flights 15 which extend from the conveyor hub 14 to a point adjacent the inner perphery or face of bowl housing 10. The conveyor hub 14 and flights 15 are rotated by gear 22 on shaft 11. After the slip or slurry has passed through this helical path, it flows around intermediate circular baffle 16 into annular pool 23 which extends toward the base of the centrifuge bowl and thence to and through effluent ports 24. All this is identical to the structure of my earlier U.S. Pat. No. 3,727,831.

Submerged in the annular effluent pool 23 are a plurality of radial arms 25 fixed on shaft 11 and terminating adjacent the inner peripheral wall of bowl housing 10. These arms are without any attachments on the outer end and are preferably aligned in a helical fashion around shaft 11. Disc stacks or vanes 26 such as Schwartz Cosap Units are preferably provided between a second set of arms 27 in the area adjacent the end of housing 10 remote from centrifugal conveyor 15. A ribbon conveyor 28 is mounted on the end of arms 27. The area from the baffle 16 to the vanes 26 is void of any vanes or conveyors and carries only arms 25.

Figure 2:
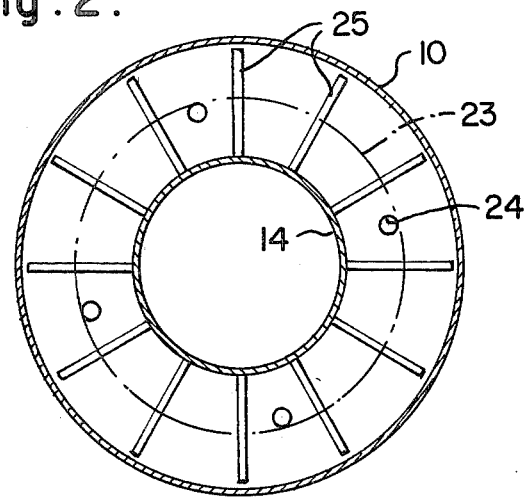
FIG. 2 is a transverse section on the line II—II of FIG. 1.
Figure 3:
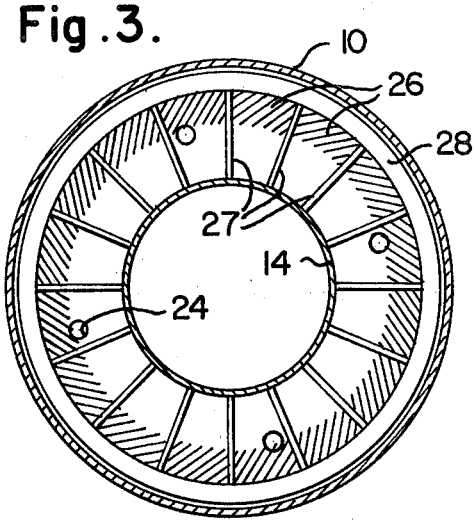
FIG. 3 is a transverse section on the line III—III of FIG. 1.
Figure 4:
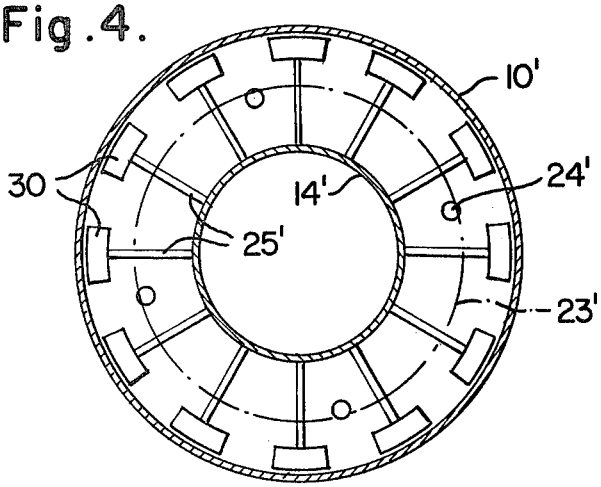
FIG. 4 is a transverse section through a second embodiment of this invention on a line equivalent to FIG. 2.

In the modification illustrated in FIG. 4, the structure is precisely the same as in FIGS. 1–3 except that each arm 25' is provided with a short spade 30 on the end remote from shaft 11. The balance of the structure is identical and all like parts bear like numbers with a prime sign.

I have compared the operation of a centrifuge according to FIG. 4 of this invention with a centrifuge of the general type illustrated in U.S. Pat. No. 3,727,831. In this comparison I prepared a clay slip and fed the same simultaneously from the same supply tank to the two centrifuges, adjusting the slip feed rate to each centrifuge so as to obtain effluent products of equal fineness, i.e. 90% $<$2 m equivalent spherical diameter (e.s.d.). The comparative run was continued for two days and tests showed that the functioning of the two centrifuges was substantially identical on both days. The test results are set out in Tables I, II and III below.

Table I

COMPARATIVE CLASSIFICATION CAPACITIES

| | 1st day | 2nd day |
|---|---|---|
| Centrifuge of this invention | 3.90 | 3.81 Ton/Hr. |
| Prior art centrifuge | 2.52 | 2.49 Ton/Hr. |

Table II

POWER CONSUMPTION

| | 1st day | 2nd day |
|---|---|---|
| Centrifuge of this invention | 22.2 | 20.0 Kw Hr./Ton |
| Prior art centrifuge | 37.7 | 37.7 Kw Hr./Ton |

Table III

COMPARISON OF CAKE OUTPUT

| | Centrifuge of this invention | Prior art centrifuge |
|---|---|---|
| Gear Load | 13.1 H.P. | Surged between 11.7–17.1 H.P. |
| Cake | 5.19 Ton/Hr. | 3.54 Ton/Hr. |
| Dil. Index | 2.9 | 3.1 |
| Viscosity | 110–320 | 100–310 |

It can be seen from the foregoing tests that the centrifuge of this invention with the spade foot arms instead of a continuous ribbon flight as in the prior art centrifuge produced about 50% more product, at low speed, with about 50% less power per ton than did the prior art centrifuge. Its power requirement was lower and steadier which suggests that it has less tendency to develop dilatant drag on conveyor flights.

In the foregoing specification I have set out certain preferred practices and embodiments of this invention; however, this invention may be otherwise embodied with the scope of the following claims.

I claim:

1. An improved process for classification and recovery of fine particle materials from a fluid suspension containing coarse, intermediate and fine particles comprising the steps of feeding a fluid slip into a rotary bowl centrifuge, maintaining the slip within said bowl in, essentially, three consecutive pools, said pools being physically and functionally demarcated by a multi-element shaft having three different types of conveyance elements which are being differentially rotated, with respect to said bowl, coaxially, within said bowl, in sequence, the first pool being served and shaped by a frusto-conical helical conveyor mounted on a shaft at one end of said bowl adjacent at least one coarse-particle-reject exit, a second pool with a cross-section substantially the same as that of the first pool, adjacent the first pool and a third pool substantially the same in cross section as the second, but extending to near effluent end of the bowl, and spaced from the first pool by the second pool to deposit the coarse particles, first on to the frusto-conical wall of the bowl, near the reject exit in the first pool followed by deposition of intermediate particles on the bowl wall of the second pool, subject to blending and propulsion whith the coarse particles by a discontinuous series of spade flights into the first pool, followed by a ribbon-type conveyor in the third pool to propel the finer sediment into the spade-type zone, and discharging the remaining slip from said bowl.

2. A method as claimed in claim 1 wherein the flow path of the sedimentated particles is actuated and, essentially, directed by relatively rotating, coaxially, the centrifuge bowl and the multi-element conveyor, whose different type elements extend near to the inner periphery of the bowl, forming therewith a continuous path for the sedimentated particles.

3. A method as claimed in claim 1 wherein the slip is divided into two or more pools by a circular baffle between the first pool and the following pools and spaced from the bowl periphery to provide a passage way along the bowl periphery from the first pool to the others.

4. The method of classifying fine particle materials from a liquid slip suspension comprising the steps of:

(a) feeding a liquid slip suspension to be classified having coarse, intermediate and fine particles into a rotating bowl centrifuge adjacent one end, (b) subjecting said slip in one portion of said bowl to a conical helical flow path against the bowl interior whereby coarse particles are thrown onto the bowl wall, (c) transferring the remaining slip to a wider pool thereon where some intermediate size particles can be settled out of the slip and, without continuous channeling of flow, (d) transferring this slip to a third pool of similar cross sectional dimensions but fitted with helical conveyance elements to propel any further intermediate size sediment counter to the slip flow into the previous zone for blending with the prior sediment and its delivery to reject, (e) discharging the mixed coarse and intermediate particles from said one end, and (f) discharging the slip and fine particles from the other end.

5. A method as claimed in claim 4 wherein the slip is fed at the axis of the helical flow path.

6. A method as claimed in claim 4 wherein the conical helical flow path is formed by relatively rotating a helical conveyor within one end of the rotating bowl.

7. A centrifuge for classifying fluid suspensions having coarse, intermediate and fine particles comprising a rotatable cylindrical bowl, a rotatable shaft on which said bowl is rotated, means for independently rotating each of said bowl and shaft at appropriate differential speeds, a circular baffle on said shaft within said bowl between the ends of said bowl, defining one of three consecutive pools, a helical conveyor on said shaft on one side of said baffle in said one pool, said conveyor extending radially to a point adjacent the periphery of the bowl, a second pool beginning on the opposite side of said baffle and extending toward the effluent end of the bowl, a helical series of discontinuous radial spokes extending from said shaft in said second pool and extending to points adjacent the periphery of the bowl, said second pool ending at a point where it joins a third pool of equal cross sectional dimension and extending toward the effluent end of the bowl, a ribbon conveyor mounted on said shaft in said third pool whose outer periphery closely approaches the inner periphery of the bowl, an input port delivering slip to be centrifuged to the helical conveyor at one end of the bowl, a particle reject port at the same end of the bowl as the input port and a slip discharge port at the opposite end of said bowl spaced from its periphery.

8. A centrifuge as claimed in claim 7 wherein the radial spokes carry discontinuous spade-type flights mounted on their tips.

9. A centrifuge as claimed in claims 7 or 8 wherein the input port is located at the axis of the bowl.

10. A centrifuge as claimed in claims 7 or 8 wherein the input end of the bowl is frusto-conical in shape.

* * * * *